United States Patent [19]

Barrett, Jr. Dave D.

[11] Patent Number: 4,649,682

[45] Date of Patent: Mar. 17, 1987

[54] PREFABRICATED BUILDING PANEL AND METHOD

[76] Inventor: Barrett, Jr. Dave D., 1416 F St., Lawton, Okla. 73501

[21] Appl. No.: 633,402

[22] Filed: Jul. 23, 1984

[51] Int. Cl.[4] ..... E04C 2/04

[52] U.S. Cl. ..... 52/221; 52/612; 52/601; 174/48

[58] Field of Search ..... 52/601, 281, 282, 745, 52/285, 241, 125.6, 125.2, 220, 221, 612; 174/48

[56] References Cited

U.S. PATENT DOCUMENTS

| | | | |
|---|---|---|---|
| 1,031,926 | 7/1912 | Hansbrough | 52/259 |
| 1,399,088 | 12/1921 | Seymour | 52/461 |
| 1,813,909 | 7/1931 | Brainard et al. | 52/285 |
| 1,862,831 | 6/1932 | Ryan | 52/221 |
| 1,953,203 | 4/1934 | Venzie | 52/587 |
| 1,983,020 | 12/1934 | De Vol | 52/601 |
| 1,990,656 | 2/1935 | Kotrbaty | 52/585 |
| 2,007,402 | 7/1935 | White et al. | 52/612 |
| 2,202,783 | 5/1940 | Morrell | 52/745 |
| 2,222,037 | 11/1940 | Lafferty | 52/125.6 |
| 2,664,740 | 1/1954 | Cochrane | 52/281 |
| 3,245,185 | 4/1966 | Rowe | 52/601 |
| 3,484,999 | 12/1969 | Van Der Lely | 52/601 |
| 3,604,174 | 9/1971 | Nelson | 52/601 |
| 3,760,540 | 9/1973 | Latoria et al. | 52/125.5 |
| 3,903,668 | 9/1975 | Megumi | 52/405 |
| 3,925,875 | 12/1975 | Doke | 52/241 |
| 4,185,437 | 1/1980 | Robinson | 52/601 |

FOREIGN PATENT DOCUMENTS

| | | | |
|---|---|---|---|
| 409319 | 9/1966 | Switzerland | 52/125.6 |

*Primary Examiner*—James L. Ridgill, Jr.
*Attorney, Agent, or Firm*—Neal R. Kennedy

[57] ABSTRACT

A prefabricated building panel having a metal, load-bearing structure which may be filled with a hardenable material. The hardenable material need not have substantial load-bearing characteristics. A frame is formed from members of substantially C-shaped cross section with at least one vertical support placed across the central opening. Reinforcing bar, lifting means, electrical receptacle boxes and interconnecting conduit for the boxes may be installed as desired. A layer of insulating material is installed in the central opening at a transversely intermediate position. Further disclosed is a method of manufacturing said panels wherein a transversely extending lip is formed around both sides of the frame. The frame is placed on a horizontal surface and a hardenable material is poured into the frame to an intermediate level to form a first surface layer. The layer of insulating material is placed on the first surface layer, and a second surface layer is formed by pouring additional hardenable material into the frame. After hardening of the surface layers, the lip is removed. Methods of installing and joining the prefabricated panels are disclosed. Door and window jambs along with windowsills may be formed in the prefabricated panels.

22 Claims, 14 Drawing Figures

PREFABRICATED BUILDING PANEL AND METHOD

BACKGROUND OF THE INVENTION

1. Field of the Invention

This invention relates to prefabricated building panels, and more particularly, to panels having a metal load-bearing structure which can be filled with a hardenable material. The hardenable material need not have substantial load-bearing characteristics.

2. Description Of The Prior Art

The prior art relating to prefabricated building panels is directed primarily at walls filled with a cementitious mixture which, when hardened, becomes a load-bearing, structural member of the wall. U.S. Pat. No. 1,031,926 to Hansbrough has a metal outer structure formed of angle iron and utilizing reinforcing rod. The structure is filled with concrete which becomes an integral load-bearing part of the structure. In the present invention, the load-bearing structure is built prior to being filled with the hardenable material, and the invention is therefore not limited to a load-bearing material such as concrete. U.S. Pat. No. 3,760,540 to Latoria discloses a similar structure to Hansbrough but uses channel iron members having openings inwardly directed. Neither of these previous patents discloses a structure utilizing a metal member having substantially C-shaped cross section such that an interlocking effect is achieved when the structure is filled with a hardenable material, as does the present invention.

U.S. Pat. No. 1,813,909 to Brainard et al. shows a building panel having a layer of insulating material between two layers of a cementitious material. Again, in Brainard, the cementitious material is load-bearing and helps support the entire structure. This is distinguished from the present invention which, although having an insulating layer, may utilize a material of lighter weight and lesser strength than a load-bearing material such as concrete.

SUMMARY OF THE INVENTION

The present invention utilizes a load-bearing, metal frame which may be filled with a hardenable material to form a solid panel.

The metal frame has a pair of vertical columns and a pair of horizontal beams which define a substantially rectilinear configuration having a central opening therethrough. Further, vertical support members may be placed between the horizontal beams and horizonally spaced as desired. Thus, a load-bearing structure is formed by the load-bearing frame and vertical support members, and the hardenable material used to fill the frame need not be a load-bearing material.

Reinforcing bar may be placed across the central opening of the frame as necessary to help support the hardened material. Also, electrical receptacle boxes and interconnecting conduit may be placed in the frame prior to filling of the hardenable material. Lifting means likewise may be installed before the hardenable material is added.

Each vertical column and horizontal beam has a substantially C-shaped cross section with a transverse member and a first flange perpendicular to the transverse member at opposite ends thereof. Each first flange extends inwardly with respect to the central opening of the frame, and each first flange has a second flange extending therefrom substantially parallel to, and opposite, the transverse member. The second flanges extend toward one another. The horizontal beams have a similar construction.

The vertical support members also have a C-shaped cross-sectional configuration, but are dimensioned such that their transverse members will fit between the second flanges of the horizontal beams.

In manufacturing the panels, an outer continuous, perimeter lip is formed around the frame and extends transversely away from the first flanges on both sides of the vertical columns and horizontal beams. The frame with these lips attached is laid flat on a smooth surface, and the central opening thereof is partially filled with the hardenable material to form a first hardened layer. A layer of insulating material is placed on the first hardened layer to cover the central opening of the frame. Hardenable material is then poured into the central opening on top of the insulating material to form a second hardened layer. The lifting means is used to raise the panel to a vertical position when the hardening process is complete.

Two panels used as walls may be attached by welding along adjacent vertical columns. In addition, brackets may be attached to vertical supports or vertical columns such that the brackets have an exposed flange flush with the hardened surface of the panel. An interior wall intersection may then be formed by welding a vertical column of an adjacent panel to these brackets.

Corners may be formed by joining the vertical columns of two walls to vertical columns forming a portion of a corner post.

Wall panels may be attached to floor and roof surfaces by welding to brackets molded into, or attached to, the floor or roof. Using similar horizontal and vertical supports as the load-bearing structure, door and window jambs and windowsills may be formed.

An important object of the invention is to provide a loadbearing frame for a prefabricated building panel, said frame utilizing horizontal and vertical members of substantially C-shaped cross section.

Another object of the invention is to provide a building panel which utilizes a load-bearing structure which can be filled with a hardenable material wherein the material, when hardened, need not have load-bearing characteristics.

A further object of the invention is to provide a method of manufacturing a prefabricated wall panel such that any intermediate supports and reinforcing within a frame are totally enclosed within a hardened panel formed by a hardenable material.

Still another object of the invention is to provide a prefabricated building panel in which an insulating layer may be enclosed between two hardened layers formed by a hardenable material.

Additional objects and advantages of the invention will become apparent as the following detailed description of the preferred embodiment is read in conjunction with the accompanying drawings which illustrate such preferred embodiments.

DETAILED DESCRIPTION OF THE PREFERRED EMBODIMENT

Figure 1:
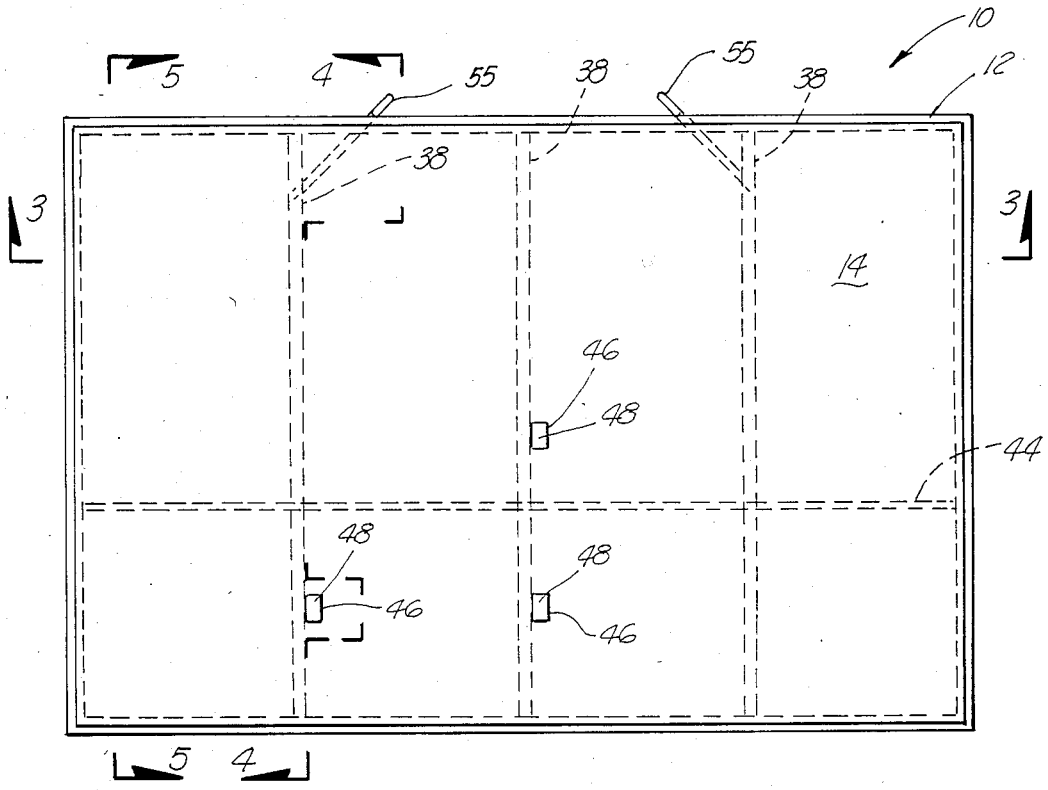
FIG. 1 shows an elevation view of a prefabricated wall panel of the present invention.

Referring now to the drawings, and particularly to FIG. 1, the prefabricated building panel of the present invention is illustrated as a wall panel, generally designated by the numeral 10. A load-bearing, metal frame 12 is filled with hardenable material, such as a cementitious mixture, in a manner hereinafter described, and said hardenable material hardens into a solid panel 14. It should be understood, however, that the structure and method of manufacture disclosed herein is not limited to walls and may be equally applied to other building panels such as roofs.

Figure 2:
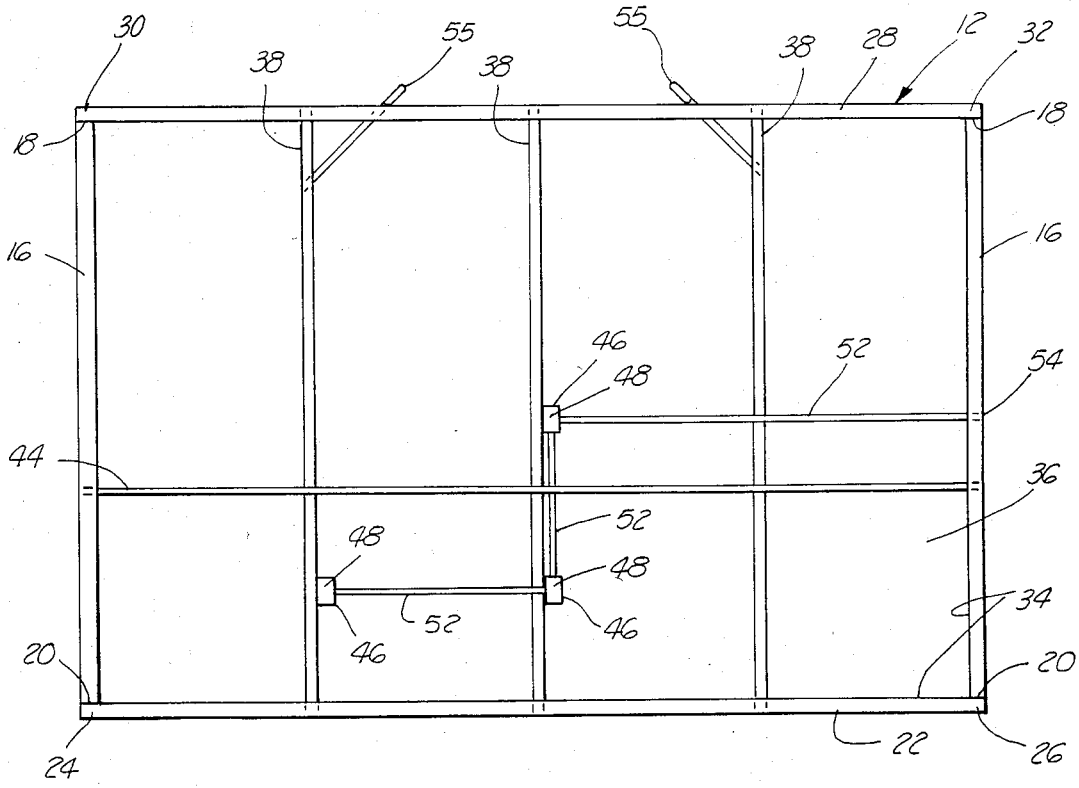
FIG. 2 illustrates a load-bearing structure, constructed in the manner of the present invention, prior to filling with a hardenable material.

Referring now to FIG. 2, frame 12 is shown before being filled with the hardenable material. Frame 12 has a pair of vertical columns 16, each having an upper end 18 and a lower end 20. A lower horizontal beam 22 has a first end 24 fixedly attached, as by welding or the like, to lower end 20 of one of vertical columns 16 and a second end 26 similarly attached to lower end 20 of the other vertical column 16. An upper horizontal beam 28 has a first end 30 attached to an upper end 18 of one of vertical columns 16 and a second end 32 similarly attached to upper end 18 of the other vertical column 16. Thus, vertical columns 16, lower horizontal beam 22 and upper horizontal beam 28 form a substantially rectilinear configuration for frame 12 having a transverse thickness and defining an inner perimeter edge 34 and a central opening 36.

Figure 3:
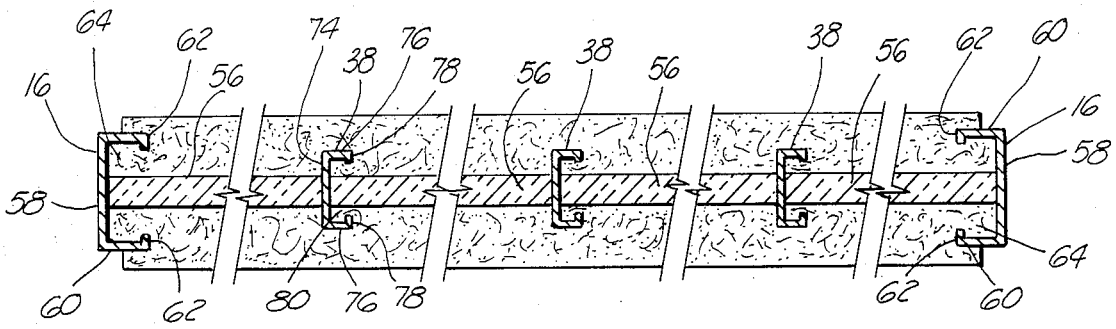
FIG. 3 is a horizontal cross section taken along lines 3—3 in FIG. 1.
Figure 4:
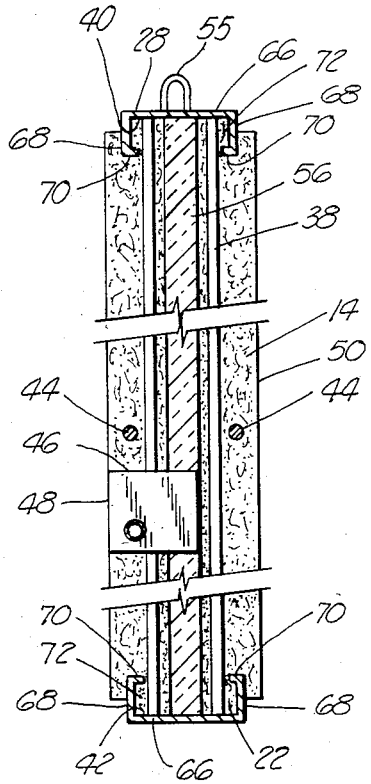
FIG. 4 is a vertical cross section taken along lines 4—4 in FIG. 1.

Extending vertically across central opening 36 of frame 12 are vertical support members 38. In FIGS. 2 and 3, three such vertical support members 38 are illustrated, but the actual number is dependent upon the length of horizontal beams 22 and 28 of frame 12, the desired spacing of the vertical supports and the required load-bearing capability. Each vertical support 38 has an upper end fixedly attached to an inner surface 40 of upper horizontal beam 28, as best shown in FIG. 4, and a lower end fixedly attached to an inner surface 42 of lower horizontal beam 22. Frame 12 and vertical support members 38 thus form a load-bearing structure before the hardenable material is poured to form panel 14. In fact, in the design of the present invention, panel 14 need not be made of a load-bearing material, thus distinguishing the structure from many previously known prefabricated building panels wherein a cementitious material becomes a load-bearing, structural part of the panel.

As illustrated in FIGS. 1, 2, 4 and 5, reinforcing bar 44, of a kind known in the art, may be placed in frame 12 to extend across central opening 36 to help support panel 14. Depending upon the application, a number of horizontal reinforcing bars 44 may be used, and similar vertical bars (not shown) also could be installed as necessary. When the hardenable material is poured to form panel 14, the reinforcing bar is totally enclosed by the hardenable material in a manner known in the art.

Electrical receptacle boxes 46 may be placed in central opening 36 in any convenient manner such as by attachment to a vertical support member 38. Each box 46 has a side defining an opening 48, and each box is positioned such that this opening is flush with external surface 50 of panel 14 and faces outwardly with respect thereto, as shown in FIG. 4. Interconnecting conduit 52 for boxes 46 also may be placed within frame 12 with an exit from the panel at a convenient location, such as that indicated by numeral 54. Conduit 52 will be enclosed by the hardenable material forming panel 14. Thus, once the panel is completely fabricated, electrical wiring may be strung through conduit 52 to boxes 46 as necessary.

Lifting means 55 may be attached to the structure in a manner known in the art. As shown in FIG. 2, lifting means 55 is a looped metal cable fixedly attached to upper horizontal beam 28 and vertical support members 38, although any suitable method may be used.

Figure 5:
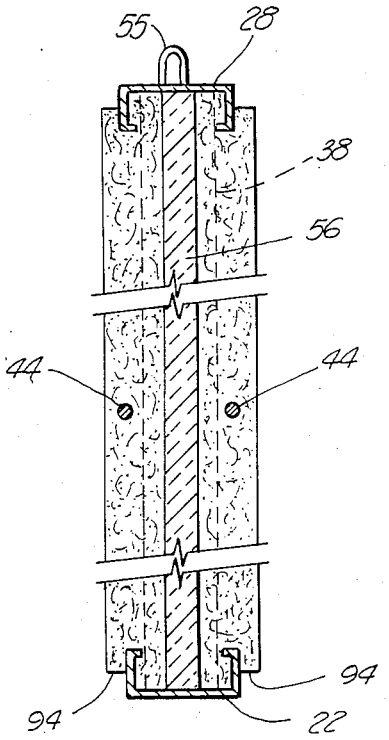
FIG. 5 shows a vertical cross-sectional view of the building panel of FIG. 1 taken along lines 5—5.

Referring again to the horizontal cross-sectional view of FIG. 3. it can be seen that a layer of insulating material 56, such as thermal or sound insulation, is placed between vertical column 16 and the adjacent vertical support member 38 and also between adjacent vertical support members 38 at a transversely intermediate position. As is shown in FIGS. 4 and 5, insulating layer 56 also extends vertically between lower horizontal beam 22 and upper horizontal beam 28. Thus, as can also be seen in FIG. 1, insulating layer 56 essentially covers all of central opening 36 of frame 12.

Once again referring to FIG. 3, each vertical column 16 has a substantially C-shaped cross section having a transverse member 58 with first flanges 60 perpendicular to transverse member 58 at opposite vertical edges thereof and extending inwardly with respect to frame 12. At an end of each of these first flanges 60 opposite transverse member 58 is a second flange 62. Second flanges 62 extend toward one another and are substantially parallel to transverse member 58. Thus, each vertical column 16 defines a longitudinal channel 64 which opens toward central opening 36. The second flanges add stiffness to the columns.

Similarly, as shown in FIG. 4, horizontal beams 22 and 28 each have a transverse member 66, first flanges 68 extending inwardly from opposite horizontal edges of the transverse member, and second flanges 70 extending transversely from the first flanges opposite, and parallel, to the transverse member, thus defining longitudinal channels 72 which open toward central opening 36. The second flanges increase the stiffness to the beams.

Referring still again to FIG. 3, it can be seen that vertical support members 38 have a substantially C-shaped cross-sectional configuration similar to that of vertical columns 16, except that vertical support members 38 are smaller. Each vertical support member 38 has a transverse member 74, first flanges 76 extending perpendicularly from the transverse member and a second flange 78 at an end of first flange 76 opposite transverse member 74. Second flanges 78 extend toward one another, are substantially parallel to transverse member 74, and act to stiffen the support member. Each vertical support member 38 defines a longitudinal channel 80, the opening direction of which is purely arbitrary; the invention is not limited to the configuration of FIG. 3. Transverse member 74 is dimensioned such that it will fit between second flanges 70 of horizontal beams 22 and 28, as shown in FIGS. 4 and 5.

Figure 6:
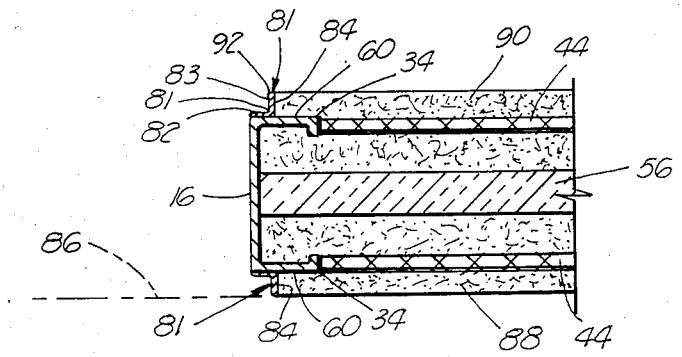
FIG. 6 is a detail showing a horizontal cross section along lines 6—6 in FIG. 1, and additionally showing perimeter lips temporarily attached during manufacture of the panel.

Referring now to FIG. 6, a method of manufacture of the prefabricated building panel of the present invention will be explained. Angle iron piece 81 has a first flange 82 which is temporarily attached, by tack welding or the like, to the external surface of first flanges 60 of both vertical columns 16. First flanges 82 of angle iron piece 81 are outwardly disposed with respect to frame 12. A second flange 83 of angle iron 81 extends transversely away from frame 12. Similar angle iron pieces (not shown) are temporarily attached to first flanges 68 of horizontal beams 22 and 28. All of the angle iron pieces are joined at the corners of frame 12 such that second flanges 83 form a continuous, perimeter lip 84 around each side of the frame outwardly spaced from inner perimeter edge 34.

Frame 12, with a lip 84 attached to each side thereof, is laid flat on a smooth surface 86 such that it rests on one of said lips, and central opening 36 is partially filled with a hardenable material which cures to form a first hardened, or cured, layer 88. Note that longitudinal channels 64 of vertical columns 16, longitudinal channels 72 of horizontal beams 22 and 28, and longitudinal channels 80 of vertical support members 38 are partially filled with the hardenable material, thus tying and interlocking first layer 88 into the load-bearing structure because second flanges 62, 70 and 78 are totally enclosed by the first layer. If reinforcing bar 44 is used, first layer 88 is preferably sufficient to totally enclose the reinforcing bar. Also, electrical receptacle boxes 46 and conduit 52 are installed prior to pouring the hardenable material.

Insulating layer 56 is placed on hardened layer 88 in central opening 36 of frame 12 as hereinbefore described. Additional reinforcing bar 44 is installed as desired, and the hardenable material is poured on top of insulating panel 56 up to a level even with a top surface 92 of upper angle iron lip 84 to form a second hardened layer 90. This also fills the remaining portion of longitudinal channels 64, 72 and 80 to tie and interlock second layer 90 into the load-bearing structure in the same manner as first layer 88. Before second layer 90 hardens completely, it can be textured as desired in a manner known in the art.

After hardening, angle iron pieces 81 are removed. Thus, hardened layers 88 and 90 are formed to have a transverse edge 94 which extends away from first flanges 60 of vertical columns 16 and first flanges 68 of horizontal beams 22 and 28 as best shown in FIGS. 3, 4 and 5, and the hardened layers totally enclose intermediate vertical support members 38.

Once the pouring and hardening processes are complete, panel 10 can be lifted to a vertical position by lifting means 55.

Figure 7:
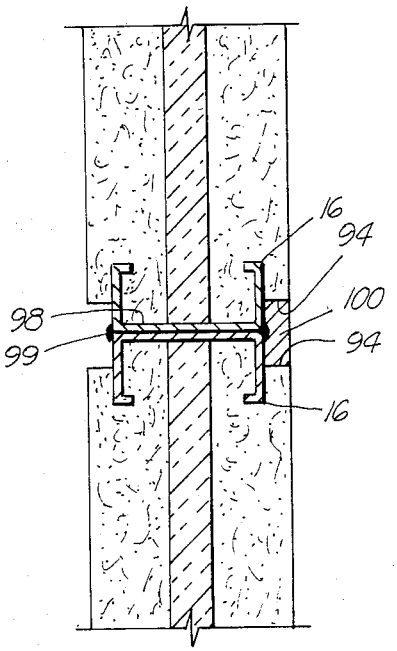
FIG. 7 is a horizontal cross section showing the joining of two adjacent colinear wall panels.

Referring now to FIG. 7 a method of attaching two colinear wall panels is disclosed. Transverse members 74 of vertical columns 16 of two adjacent panels are joined along surface 98. Preferably, a continuous weld 99 is made along the edges of surface 98. The gap between opposite transverse edges 94 makes any misalignment of the adjacent panel less noticeable. The gap may be filled with caulking material 100 on both interior and exterior joints. In addition, on interior joints, the gap may be further finished by taping and sanding, then painting the wall as with any conventional interior wall joint.

Figure 8:
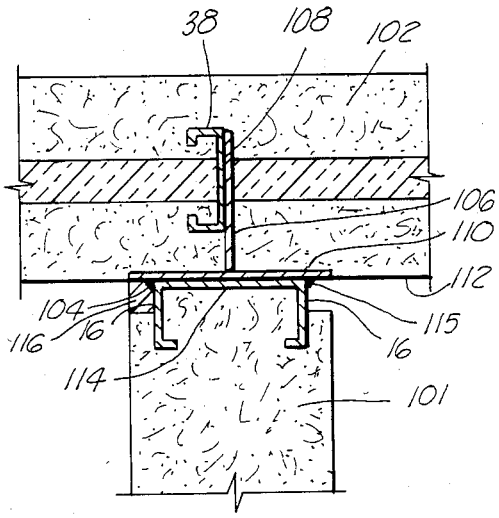
FIG. 8 illustrates a horizontal cross section of an interior wall intersecting a single exterior wall.

FIG. 8 illustrates a wall intersection in which an interior wall 101 intersects an exterior wall 102. In this embodiment, a bracket 104 of substantially T-shaped cross section has a transverse flange 106 attached, by welding or the like, to a transverse side of a vertical support member 38 along surface 108 and a base flange 110 arranged to be flush with interior surface 112 of exterior wall 102. The transverse member of a vertical column 16 of interior wall 101 is attached to base flange 110 of bracket 104 along surface 114, preferably by means of continuous weld 115. The gaps between the adjoining walls may be filled with caulking material 116 and finished as described above for colinear walls.

Figure 9:
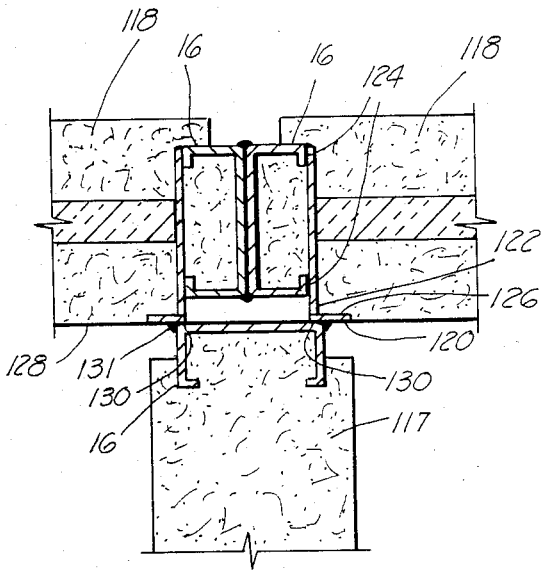
FIG. 9 is a horizontal cross section illustrating the intersection of an interior wall with two exterior walls.

FIG. 9 illustrates an alternate embodiment of a wall intersection in which an interior wall 117 intersects two exterior walls 118. A vertical column 16 of each wall 118 has a bracket 120 of substantially L-shaped cross section having a transverse flange 122 attached along surface 124 to the second flanges of the corresponding vertical column. Each bracket 120 has a base flange 126 extending substantially perpendicularly from transverse flange 122 and positioned to be flush with interior surface 128 of the respective exterior wall 118. Brackets 122 are attached to adjacent vertical column 16 of interior wall 117 at points 130. Preferably, joining is by a continuous weld 131. The gaps between the walls may be filled and finished as already described.

Figure 10:
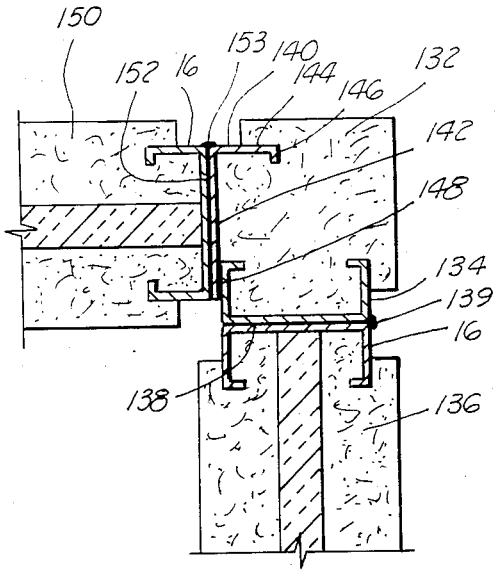
FIG. 10 is a horizontal cross section of two adjacent, perpendicular walls joined by a corner post.

In FIG. 10, a corner installation of two walls of the construction of the present invention is shown. A vertical corner post 132 has a vertical column 134 identical to vertical column 16 of wall 136. Vertical column 134 of post 132 and vertical column 16 of wall 136 are joined along surface 138 by continuous weld 139 in the manner hereinbefore described. Vertical corner post 132 also has a partial vertical column 140 having a transverse member 142 similar to that of the vertical columns hereinbefore described, but having a single first flange 144 and a single second flange 146. Transverse member 142 of partial vertical column 140 is attached to a first flange of vertical column 134 along surface 148. Transverse member 142 of partial vertical column 140 is attached to the transverse member of vertical column 16 of wall 150 along surface 152 preferably by continuous weld 153. Again, the gaps between the walls and post may be filled and finished as desired.

Figure 11:
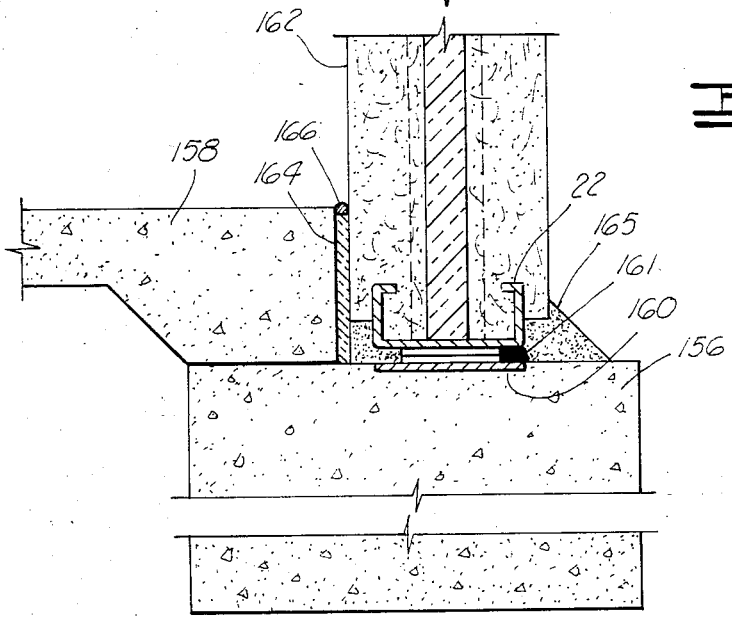
FIG. 11 is a vertical cross section of a building utilizing the building panel of the present invention as a wall, and showing details of attachment of the wall to a floor surface and a roof structure.

FIG. 11 shows a preferred method of mounting a wall 154 to a footing 156 and floor 158. Footing 156, which is typically concrete, has a plate 160 molded therein. Lower horizontal beam 22 of wall 154 is preferably attached to plate 160 by continuous weld 161 or the like. Floor 158, which may also include a hardenable material, is placed on footing 156 adjacent an interior surface 162 of wall 154 with an expansion joint 164 therebetween. Caulking material 166 is placed on top of expansion joint 164 to seal between interior wall surface 162 and floor 158. Corner fill 165 is used to cover the external joint between wall 154 and footing 156.

FIG. 11 also shows a preferred method of attaching a roof 168 to wall 154. A bracket 170 is molded in wall 154 in the previously discussed manner of bracket 104 shown in FIG. 8 and brackets 120 shown in FIG. 9. An angle iron support 172 has a vertical flange 174 attached to bracket 170 along surface 176 by weld 177 and a horizontal flange 178 attached to roof 168 in a manner known in the art. A cap 180 is placed over upper support beam 28 of wall 154 and has flashing 182 and 184 to act as weatherproofing in a manner also known in the art.

Figure 12:
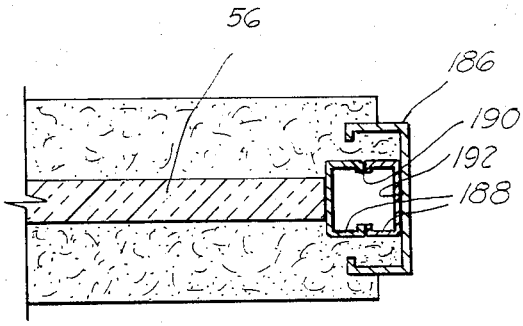
FIG. 12 is a horizontal cross section of a door or window jamb.

In the horizontal cross section of FIG. 12, a jamb detail at a window or door opening is shown. A vertical member 186 defines the exterior of the jamb and is formed in the wall structure in the manner described above for vertical column 16. A pair of smaller vertical supports 188, similar to vertical support 36, are joined at their second flanges along surface 190, thus defining a box-like cross section. One of vertical supports 188 is attached to the inner transverse surface of vertical member 186 along surface 192.

Figure 13:
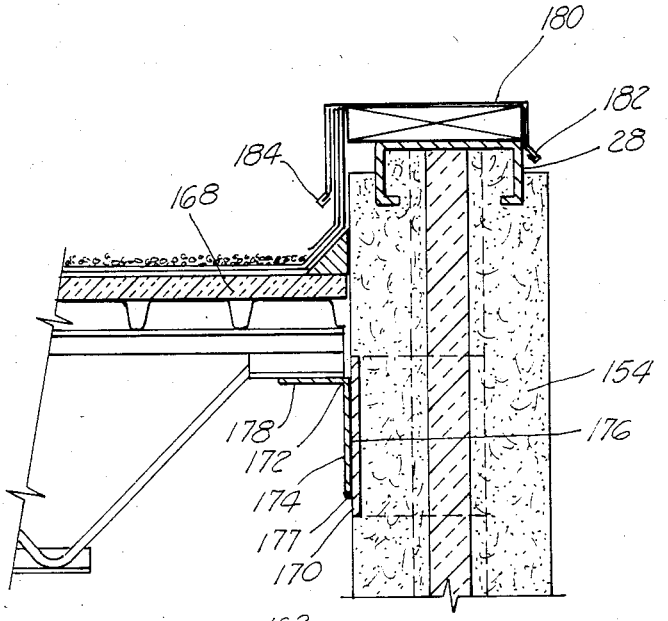
FIG. 13 is a vertical cross section of a door or window jamb.
Figure 13:
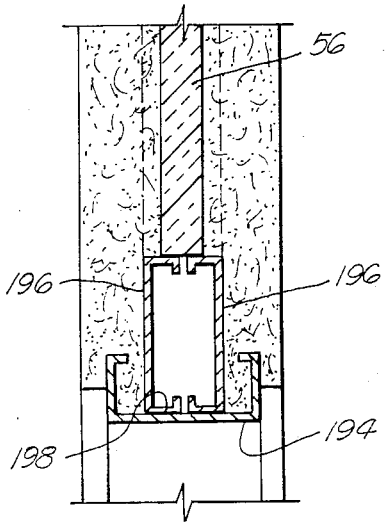

A vertical cross section of a door or window jamb is shown in FIG. 13. Horizontal member 194 forms the upper horizontal surface of the jamb and is integrated into the wall in a manner similar to horizontal beam 22. Two horizontal supports 196, opening toward one another, are positioned such that their transverse members are vertically oriented. A first flange of each horizontal support 196 is attached to the inner transverse surface of horizontal member 194 along surface 198.

Figure 14:
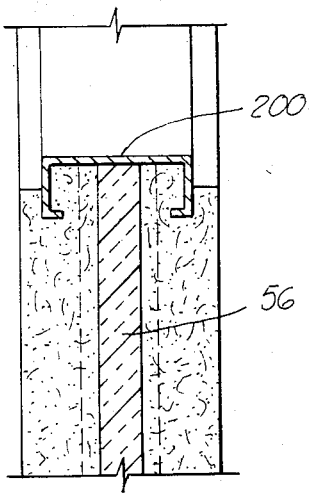
FIG. 14 shows a vertical cross section of a window-sill treatment for the prefabricated building panel of the present invention.

A preferred windowsill treatment is shown in the vertical cross section of FIG. 14. A horizontal member 200 forms the sill and is integrated into the wall in a manner similar to horizontal beam 28.

It can be seen that the prefabricated building panel of the present invention is well adapted to carry out the objects and attain the ends and advantages mentioned, as well as those inherent therein. While a presently preferred embodiment of the invention, shown as a wall panel, has been described for the purposes of this disclosure, numerous changes in the construction and arrangement of parts can be made by those skilled in the art. All such changes are encompassed within the scope and spirit of this invention as defined by the appended claims.

What is claimed is:

1. A prefabricated building panel comprising:

a metal, load-bearing frame defining a central opening therethrough and comprising:

a pair of vertical columns of substantially C-shaped cross section having a transverse member, a pair of first flanges extending from opposite vertical edges of said transverse member and a second flange extending transversely from each of said first flanges opposite, and substantially parallel, to said transverse member, such that each of said vertical columns defines a longitudinal channel opening inwardly toward said central opening;

a lower horizontal beam having a first end attached to a lower end of one of said vertical columns and a second end attached to a lower end of the other of said vertical columns, said lower horizontal beam being of substantially C-shaped cross section having a transverse member, a pair of first flanges extending upwardly from opposite horizontal edges of said transverse member and a second flange extending transversely from each of said first flanges opposite, and substantially parallel, to said transverse member such that said lower horizontal beam defines a longitudinal channel opening upwardly and inwardly toward said central opening; and an upper horizontal beam having a first end attached to an upper end of one of said vertical columns and a second end attached to an upper end of the other of said vertical columns, said upper horizontal beam being of substantially C-shaped cross section having a transverse member, a pair of first flanges extending downwardly from opposite horizontal edges of said transverse member and a second flange extending transversely from each of said first flanges opposite, and substantially parallel, to said transverse member, such that said upper horizontal beam defines a longitudinal channel opening downwardly and inwardly toward said central opening of said frame;

a transversely extending lip attached to said frame around a perimeter thereof adjacent said central opening; and at least one metal vertical support member of substantially C-shaped cross section having a transverse member, a pair of first flanges extending from opposite vertical edges of said transverse member and a second flange extending transversely from each of said first flanges opposite, and substantially parallel, to said transverse member, said vertical support member having a lower end attached to said lower horizontal beam and an upper end attached to said upper horizontal beam.

2. The prefabricated building panel of claim 1 wherein said lip is detachable from said frame.

3. The prefabricated building panel of claim 1 wherein said transverse member of said vertical support member is dimensioned to fit between said second flanges of said upper and lower horizontal beams such that an upper end of said vertical support member contacts an inner surface of said transverse member of said upper horizontal beam and a lower end of said vertical support member contacts an inner surface of said transverse member of said lower horizontal beam.

4. The prefabricated building panel of claim 1 further comprising an insulating material installed in said central opening of said frame.

5. The prefabricated building panel of claim 1 further comprising a hardened surface layer formed from a hardenable material filling said central opening of said frame and enclosing said vertical support member, said hardened surface layer disposed transversely with respect to said frame and flush with a transversely outermost edge of said lip.

6. The prefabricated building panel of claim 1 further comprising:

an electrical receptacle box positioned in said central opening of said frame; and electrical conduit connected to said electrical receptacle box.

7. The prefabricated building panel of claim 1 further comprising lifting means attached to said frame for lifting said frame and said vertical support member therein.

8. A prefabricated building panel comprising:

a metal, outer load-bearing frame defining a central opening therethrough and comprising:

an upper horizontal beam of substantially C-shaped cross section defining a longitudinal channel therein opening toward said central opening;

a lower horizontal beam of substantially C-shaped cross section defining a longitudinal channel therein opening toward said central opening; and a pair of vertical columns extending between said upper and lower horizontal beams and forming opposite vertical sides of said frame, each of said vertical columns being of substantially C-shaped cross section and defining a longitudinal channel therein opening toward said central opening;

a lip attached to said frame and extending transversely from said upper and lower horizontal beams in said vertical columns around and adjacent said central opening; and a hardened surface layer formed by filling said central opening of said frame with a hardenable material and curing said material, said surface layer filling said longitudinal channels and having a longitudinal surface flush with said lip.

9. The prefabricated building panel of claim 8 wherein said lip is detachable from said frame after said hardened surface layer is formed.

10. The prefabricated building panel of claim 8 further comprising lifting means attached to said frame and extending upwardly from said upper horizontal beam for lifting said frame with said hardened layer contained therein.

11. The prefabricated building panel of claim 8 further comprising at least one reinforcing bar, extending across said central opening, totally enclosed by said hardened layer.

12. The prefabricated building panel of claim 8 further comprising a layer of insulating material imbedded in said hardened layer at a transversely intermediate position therein.

13. The prefabricated building panel of claim 8 further comprising:

an electrical receptacle box having an outwardly facing opening flush with an outer surface of said hardened layer; and electrical conduit connected to said receptacle box and imbedded in said hardened layer.

14. A prefabricated wall structure comprising:

a metal, outer load-bearing frame defining a central opening therethrough and comprising:

an upper horizontal beam of substantially C-shaped cross section defining a longitudinal channel therein opening toward said central opening;

a lower horizontal beam of substantially C-shaped cross section defining a longitudinal channel therein opening toward said central opening; and a pair of vertical columns extending between said upper and lower beams, fixedly attached thereto, and forming opposite vertical sides of said frame, each of said vertical columns being of substantially C-shaped cross section and defining a longitudinal channel therein opening toward said central opening;

said frame having a first side and a second side;

a transversely extending perimeter lip attached to each of said first and second sides of said frame, each lip extending transversely away from said frame;

an intermediate vertical support member extending between said upper and lower beams, fixedly attached thereto, horizontally spaced between said pair of vertical columns, and parallel thereto and further being of substantially C-shaped cross section defining a longitudinal channel therein;

a layer of insulating material extending across said central opening;

a first surface layer extending across said central opening and covering said vertical support and a first side of said insulating layer and having a surface substantially parallel to said first side of said frame, said surface being flush with said lip attached to said first side of said frame; and a second surface layer extending across said central opening on a second side of said insulating layer opposite said first surface layer and covering said vertical support and a second side of said insulating layer and having a surface substantially parallel to said second side of said frame, said surface of said second surface layer being flush with said lip attached to said second side of said frame.

15. The prefabricated wall structure of claim 14 further comprising:

an electrical receptacle box having an outwardly facing opening flush with an outer surface of at least one of said first and second surface layers; and electrical conduit connected to said receptacle box and covered by at least one of said first and second surface layers.

16. The prefabricated wall structure of claim 14 further comprising lifting means attached to said frame.

17. The prefabricated wall structure of claim 16 wherein said lifting means comprises a looped cable extending upwardly from an upper surface of said upper horizontal beam.

18. The prefabricated wall structure of claim 14 wherein said first and second surface layers are hardened layers formed by filling said central opening of said frame with a hardenable material and curing said material.

19. The prefabricated wall structure of claim 18 further comprising a reinforcing bar extending across said central opening located in a position wherein it is embedded in at least one of said first and second surface layers.

20. The prefabricated wall structure of claim 19 wherein said bar is located parallel to said upper and lower horizontal beams.

21. The prefabricated wall structure of claim 18 wherein said lips on said first and second sides of said frame are detachable therefrom after said hardened layers are formed.

22. The prefabricated wall structure of claim 21 wherein each of said lips comprises an angle iron having a first flange attached to the corresponding side of said frame and a second flange positioned inwardly from said first flange with respect to said central opening.

* * * * *